US009586431B2

(12) United States Patent
Kurohata

(10) Patent No.: US 9,586,431 B2
(45) Date of Patent: Mar. 7, 2017

(54) IMAGE FORMING SYSTEM, IMAGE FORMING APPARATUS, FINISHER AND METHOD OF CONTROLLING IMAGE FORMING SYSTEM

(71) Applicant: Konica Minolta, Inc., Tokyo (JP)

(72) Inventor: Takao Kurohata, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 376 days.

(21) Appl. No.: 14/466,280

(22) Filed: Aug. 22, 2014

(65) Prior Publication Data

US 2015/0063951 A1 Mar. 5, 2015

(30) Foreign Application Priority Data

Aug. 30, 2013 (JP) ..... 2013-179558

(51) Int. Cl.

| | |
|---|---|
| ***B42C 19/02*** | (2006.01) |
| ***B41J 11/66*** | (2006.01) |
| ***B42C 1/12*** | (2006.01) |
| ***G03G 15/00*** | (2006.01) |

(52) U.S. Cl.

CPC ..... *B42C 19/02* (2013.01); *B41J 11/663* (2013.01); *B42C 1/12* (2013.01); *G03G 15/6544* (2013.01); *G03G 15/6591* (2013.01); *G03G 2215/00476* (2013.01); *G03G 2215/00814* (2013.01);

(Continued)

(58) Field of Classification Search

CPC B42C 19/00; B42C 19/02; B42C 1/00; B42C 1/12; B41J 11/66; B41J 11/70; B41J 11/663; G03G 21/00; G03G 15/6544; G03G 15/6591; G03G 2215/00476; G03G 2215/00814; G03G 2215/00822; G03G 2215/00869; G03G 2215/00936

See application file for complete search history.

(56) References Cited

U.S. PATENT DOCUMENTS

| | | | | |
|---|---|---|---|---|
| 2010/0157326 A1* | 6/2010 | Mori | ..... | G03G 15/5029 358/1.5 |
| 2012/0034050 A1* | 2/2012 | Uno | ..... | B65H 37/04 412/1 |
| 2012/0243961 A1* | 9/2012 | Toda | ..... | G03G 15/6544 412/1 |

FOREIGN PATENT DOCUMENTS

| | | | | |
|---|---|---|---|---|
| JP | 2003-260833 A | | 9/2003 | |
| JP | 2003260833 A | * | 9/2003 | ..... B41J 11/70 |
| JP | 2003-323272 A | | 11/2003 | |

(Continued)

*Primary Examiner* — Nguyen Ha

(74) *Attorney, Agent, or Firm* — Lucas & Mercanti, LLP

(57) ABSTRACT

An image forming system is described which is capable of assembling an output product which consists of sheets having uniform sheet widths by appropriately performing a trimming process even if the output product is made from a plurality of paper types. The image forming system consists of an image forming apparatus configured to form an image on a sheet; a finisher provided with a slit unit for trimming edges of sheets and capable of assembling an output product by joining the trimmed sheets, and a control unit for controlling the image forming apparatus and the finisher. When a book cover (standard paper type sheet) is supplied, the control unit trims the paper edges by a designated trimming width. Conversely, when a book body (non-standard paper type sheet) is supplied, the control unit trims the paper edges by a designated trimming width to which an offset amount is added.

20 Claims, 5 Drawing Sheets

(52) U.S. Cl.
CPC ..... *G03G 2215/00822* (2013.01); *G03G 2215/00869* (2013.01); *G03G 2215/00936* (2013.01)

(56) References Cited

FOREIGN PATENT DOCUMENTS

JP WO 2010131464 A1 * 11/2010 ..... B65H 37/04

* cited by examiner

| BOOK COVER | BOOK BODY | OFFSET AMOUNT |
|---|---|---|
| cardboard | standard sheet | 1 mm |
| cardboard | thin sheet | 2 mm |
| standard sheet | thin sheet | 1 mm |
| standard sheet | cardboard | −1 mm |
| thin sheet | standard sheet | −1 mm |
| thin sheet | cardboard | −2 mm |

IMAGE FORMING SYSTEM, IMAGE FORMING APPARATUS, FINISHER AND METHOD OF CONTROLLING IMAGE FORMING SYSTEM

CROSS-REFERENCE TO RELATED APPLICATIONS

The present application claims priority under 35 U.S.C. §119 to Japanese Patent Application No. 2013-179558, filed on Aug. 30, 2013. The contents of this application are herein incorporated by reference in their entirety.

FIELD OF INVENTION

The present invention relates to an image forming system, an image forming apparatus, a finisher and a method of controlling the image forming system.

DESCRIPTION OF RELATED ART

Conventionally, in an image forming apparatus, a finisher or an image forming system including such an apparatus and a finisher, a plurality of sheets are bound together to provide an output product such as a saddle-stitched booklet or a single-side binding booklet. This kind of apparatus is provided with a slit unit for cutting off (i.e., trimming) the edges of sheets. When sheets are supplied from a sheet source, the apparatus trims the edges (for example, top and bottom edges) of the sheets one after another in succession with the slit unit and binds together the trimmed sheets to provide an output product. It is therefore possible to make up a good-looking high quality output product which consists of sheets having uniform sheet widths.

For example, Japanese Patent Published Application No. 2003-323272 discloses a printing apparatus provided with a cutter for successively cutting continuous form paper supplied from a paper roll into separate sheets. This printing apparatus can use a variety of paper types such as cloth, vinyl and the like materials in addition to usual paper materials, and thereby a transmission unit supplies the printing apparatus with the setting data relating to the trimming process suitable for trimming each material with the cutter as well as print data. By this configuration, users need not designate the suitable trimming process by operating the printing apparatus so that there is a little possibility of damaging the cutter and sheets due to operation errors.

Also, for example, Japanese Patent Published Application No. 2003-260833 discloses a recording apparatus provided with a cutter device for cutting off recording media. When transferring paper from a paper roll to a cutter blade by a conveyance roller, a slip occurs between the paper and the conveyance roller, and the amount of slip varies depending upon the type of paper. The control unit of the recording apparatus thereby transfers a cut line printed on the paper to the cutter blade by adding a correction value to the rotational amount of the conveyance roller required for transferring the paper from the paper roll to the cutter blade. The correction value is specifically determined in correspondence with the type of paper. It is said that the paper can be cut off at an accurate position.

However, in the case where a plurality of paper types are handled to provide an output product as has been discussed above, the cutting positions can be misaligned between different paper types, and therefore there is a problem that the output product consists of sheets having uneven widths. While paper sheets are cut off one by one for making up an output product, the cutting operation is sometimes performed with a sheet being warped by its own weight. The warp amounts differ between the paper types, and the differential warp amount results in the misalignment of cutting positions between different types.

The present invention has been made in order to solve the problems as described above. It is an object of the present invention therefore to provide a system capable of assembling an output product which consists of sheets having uniform sheet widths by appropriately performing a trimming process even if the output product is made from a plurality of paper types.

SUMMARY OF THE INVENTION

To achieve at least one of the abovementioned objects, an image forming system reflecting one aspect of the present invention comprises: an image forming apparatus configured to form an image on a sheet; a finisher provided with a slit unit for trimming edges of sheets which are successively supplied from the image forming apparatus, and configured to assemble an output product by joining the trimmed sheets; and a control unit configured to control each of the image forming apparatus and the finisher. Particularly, the finisher can assemble the output product with sheets of a plurality of paper types including a standard paper type and a non-standard paper type which is different from the standard paper type, and the control unit comprises: a paper type notification unit configured to notify which of the standard paper type and non-standard paper type is supplied to the finisher from the image forming apparatus; a finisher control unit configured to control the operation of the slit unit in accordance with the paper type of sheets supplied to the finisher; and an offset amount designation unit configured to designate an offset amount corresponding to the displacement of the sheet width of the non-standard paper type in relation to the sheet width of the standard paper type. In this case, when the paper type notification unit notifies that the non-standard paper type is supplied, the finisher control unit trims the edge of a sheet on the basis of the offset amount designated by the offset amount designation unit.

In accordance with the present invention as described above, it is preferred that the control unit further comprising a base trimming width designation unit which designates a trimming width of the edge of a sheet for assembling the output product, and wherein when the paper type notification unit notifies that the standard paper type is supplied, the finisher control unit trims the edge of a sheet in accordance with the trimming width designated by the base trimming width designation unit, and when the paper type notification unit notifies that the non-standard paper type is supplied, the edge of a sheet is trimmed in accordance with a corrected trimming width calculated by adding the offset amount designated by the offset amount designation unit to the trimming width designated by the base trimming width designation unit.

Also, it is preferred that the output product consists of a book cover and a book body which is made from sheets of one or more paper type different from that of the book cover, and wherein the paper type notification unit notifies, when the supplied sheet is used as a book cover, that the standard paper type is supplied, and notifies, when the supplied sheet is used as a book body, that the non-standard paper type is supplied.

Furthermore, it is preferred that the image forming system further comprises an input unit through which a user can perform input operation. In this case, the offset amount designation unit designates the offset amount on the basis of the amount designated by the user through the input unit.

Still further, it is preferred that the image forming system further comprises a storing device configured to store a table in which is defined an offset amount of the non-standard paper type in relation to the standard paper type corresponding to a variety of combinations of the non-standard paper type and the standard paper type. In this case, the offset amount designation unit designates the offset amount with reference to the table stored in the storing device.

Still further, it is preferred that the offset amount designation unit designates the offset amount on the basis of the size of the supplied sheet.

Still further, it is preferred that when the corrected trimming width exceeds the maximum trimming width which can be trimmed by the slit unit, the finisher control unit replaces the corrected trimming width by the maximum trimming width, and trims the edge of a sheet in accordance with the trimming width after replacement.

Still further, it is preferred that the image forming system further comprises a notification unit configured to notify a user of information. In this case, when the corrected trimming width exceeds the maximum trimming width which can be trimmed by the slit unit, the finisher notifies that the corrected trimming width exceeds the maximum trimming width through the notification unit.

Still further, it is preferred that after trimming the paper edges of sheets by the slit unit, the finisher performs a predetermined post-printing process on the trimmed sheets to provide the output product.

DETAILED DESCRIPTION OF THE PREFERRED EMBODIMENT (First Embodiment)

Figure 1:
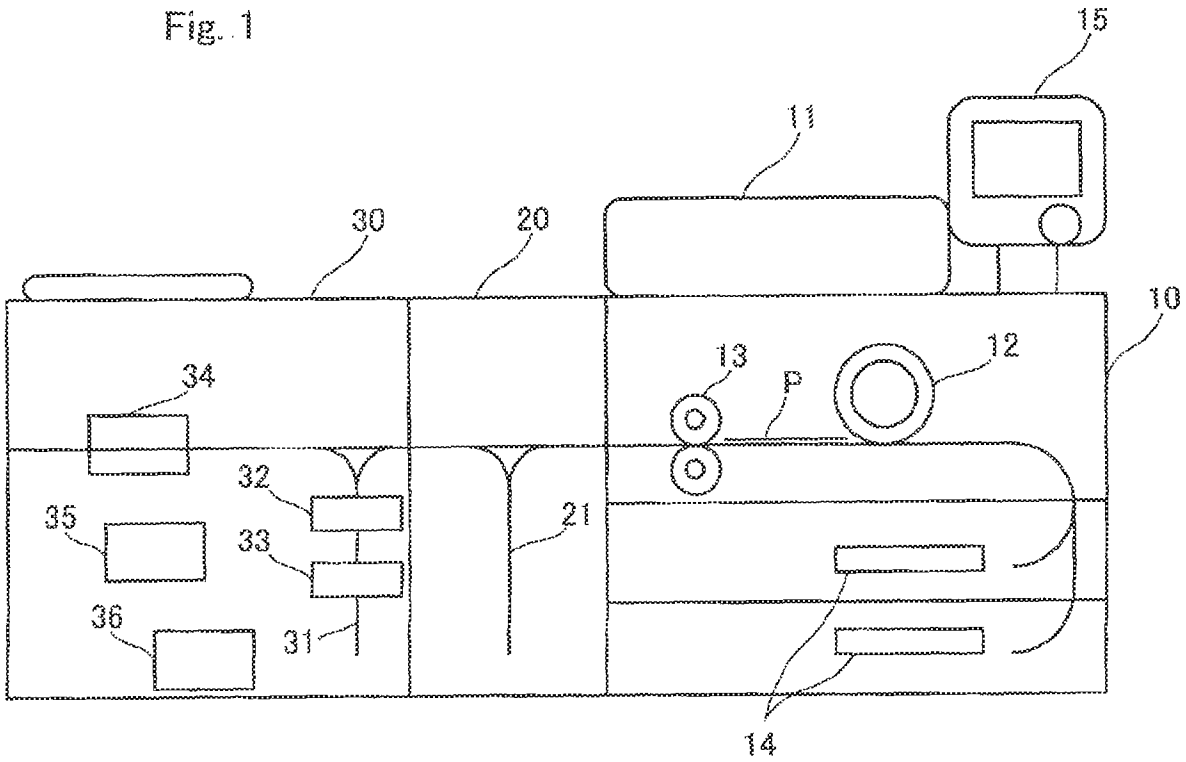
FIG. 1 is an explanatory view for schematically showing the overall configuration of an image forming system in accordance with a first embodiment of the present invention.

FIG. 1 is an explanatory view for schematically showing the overall configuration of the image forming system in accordance with this first embodiment of the present invention. This image forming system consists mainly of an image forming apparatus 10, an intermediate conveyance unit 20 and a finisher 30. The image forming apparatus 10, the intermediate conveyance unit 20 and the finisher 30 are connected in series from the upstream to the downstream with respect to the direction of conveying sheets.

The image forming apparatus 10 is an apparatus which forms an image on a sheet P on the basis of image data. The image forming apparatus 10 consists mainly of an original reading unit 11, an image forming unit 12, a fixing unit 13, a paper feed unit 14 and a manipulation display 15.

The original reading unit 11 is located on the top of the housing of the image forming apparatus 10, and provided with an automatic document feeder for automatically taking and feeding originals to this feeder when reading images thereof. This original reading unit 11 reads an image from an original and outputs a predetermined image signal. The output image signal is converted into image data by performing necessary processes such as AD conversion.

The image forming unit 12 is for example an electrophotographic image forming unit. Around a photoreceptor unit in the form of a drum, not shown in the figure, there are arranged a charging unit, an exposure unit, a developing unit, a transfer unit, a separation unit, and a cleaning unit in the image forming unit 12. These units forming the image forming unit 12 cooperates with each other to form an image (toner image) on the photoreceptor unit by charging, exposing and developing, and then form an image on a sheet P by transferring the image.

The fixing unit 13 is provided with a heat roller and a pressure roller to fix an image onto a sheet P by heating and pressing the sheet P on which the image has been formed by the image forming unit 12.

The paper feed unit 14 includes a plurality of paper feed trays. Each paper feed tray is used to store sheets P. Different paper feed trays may be used to store sheets P having different types and/or sizes. When sheets are supplied, one paper feed tray is selected of the paper feed unit 14 to feed the sheet P from the selected paper feed tray.

The manipulation display 15 is for example a touch panel (input unit) through which users can input setting information with reference to the information displayed on the panel. Through this manipulation display 15, users can designate the specifications of a job, for example, the mode of single/double-side printing, the density and reduce/enlarge ratio of images, the use of saddle-stitching, the paper types used for forming a book cover and a book body respectively, whether to trim (cut) off sheets at top and bottom edges, the number of pages to be trimmed and the cutting amounts (trimming widths) thereof, and so forth. On the other hand, the manipulation display 15 can notify a user of predetermined information by displaying the information on the display (as a notification unit)

The intermediate conveyance unit 20 is located in the downstream side of the image forming apparatus 10, and conveys sheets P discharged from the image forming apparatus 10 to the finisher 30. This intermediate conveyance unit 20 is provided with a sheet reversing unit 21 which is used to reverse the front and back sides of a sheet P if necessary.

The finisher 30 is an apparatus for processing sheets P successively supplied from the image forming apparatus 10 as a paper source to join a plurality of sheets P and provide one output product. The finisher 30 of the present embodiment is a saddle-stitching apparatus which joins a plurality of sheets P together and saddle-stitches the joined sheets to assemble a booklet (saddle-stitched booklet). In this case, the finisher can form a booklet consisting of a book cover and a book body. The book cover and the book body can be made from different materials, for example, a cardboard for the book cover and a thin sheet for the book body.

The finisher 30 is provided with a reversing stack unit 31, a slit unit 32, a creasing unit 33, a saddle-stitching unit 34, an SQF (SQuare Fold) unit 35 and a fore edge trimming unit 36.

The reversing stack unit 31 receives a sheet P supplied from the image forming apparatus 10, and makes the sheet P enter a predetermined reversing stack route and be put on standby. Namely, each time a sheet P is supplied from the image forming apparatus 10, the reversing stack unit 31 repeats the entering/standby action of the sheet P to join a plurality of sheets P together. The reversing stack unit 31 then sends out the joined sheets P (sheet stack) by switch-back operation to supply the joined sheets to the downstream side of the conveying route.

The slit unit 32 has the function of trimming the edges of a sheet P, i.e., opposite edges corresponding to the top and bottom edges of the sheet in the case of the present embodiment. This slit unit 32 is located in the middle of the reversing stack route to perform the edge trimming operation of each sheet P supplied from the image forming apparatus 10 one after another when the sheet P is transferred to the stand-by position of the reversing stack unit 31.

The creasing unit 33 has the function of making a folding line on a sheet P. The creasing unit 33 can make a folding line on a sheet stack formed by the reversing stack unit 31 in the center position of the sheet stack.

The saddle-stitching unit 34 performs a saddle-stitching operation on the sheet stack which is sent out from the reversing stack unit 31, and provided with a folding unit (not shown in the figure) and saddle-stitching staple units (not shown in the figure). The folding unit consists of a sheet pushing unit, folding rollers, a transfer belt, a pressure roller and so forth. The folding unit upward obliquely moves a pushing plate of the sheet pushing unit, and pushes upward the center portion of the sheet stack such that the folding rollers are pushed upward, pivoted and separated from each other at the nip portion therebetween by the sheet stack. After the tip portion of the pushing plate is passed through the nip portion, the pushing plate is retracted from the nip portion so that the center portion of the sheet stack is gripped by the folding rollers to form a folding line. The saddle-stitching staple units are arranged in a pair in the direction perpendicular to the paper conveying direction, and capable of moving by a driving means (not shown in the figure) in the direction perpendicular to the paper conveying direction. After transferring the sheet stack, which is center folded by the folding unit, to a predetermined position, the saddle-stitching staple units fasten the sheet stack with staples (U-shaped wire pieces) in two positions distant from the center in the width direction.

The SQF unit 35 performs a square folding process on the sheet stack which is center folded by the saddle-stitching unit 34. The SQF unit 35 includes a roller which is used to press and flatten the folded portion (backbone) of the sheet stack in the form of a square shape.

The fore edge trimming unit 36 consists of an upper trimming blade, a lower trimming blade, movable plates, a pressure roller, a driving means and so forth. The fore edge trimming unit 36 trims the fore edge of the sheet stack folded by the saddle-stitching unit 34 in the form of a booklet to make the fore edge flat.

Figure 2:
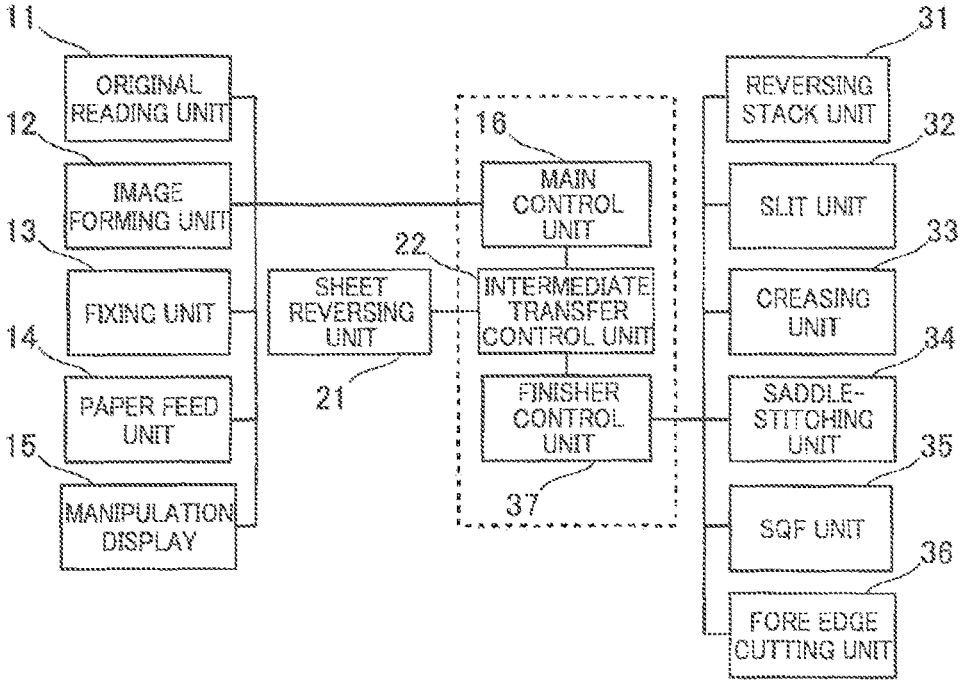
FIG. 2 is a block diagram showing the control configuration of the image forming system as shown in FIG. 1.

FIG. 2 is a block diagram showing the control configuration of the image forming system in accordance with the present embodiment. The image forming system includes a control unit which consists of a main control unit 16, an intermediate transfer control unit 22 and a finisher control unit 37. These control units serve to individually control the apparatuses 10, 20 and 30 respectively. Specifically speaking, the main control unit 16 controls the image forming apparatus 10, and the intermediate transfer control unit 22 controls the intermediate conveyance unit 20. Also, the finisher control unit 37 controls the finisher 30.

The main control unit 16 is designed to communicate with the intermediate transfer control unit 22 and the finisher control unit 37 to integrally control the operation of the image forming system in operative association with these control units 22 and 37.

In accordance with the present embodiment, when assembling a booklet with a plurality of paper types, the main control unit 16 (as a paper type notification unit) of the image forming system notifies the finisher control unit 37 of the paper type of a sheet P supplied from the image forming apparatus 10 to the finisher 30, i.e., which of a standard paper type and a non-standard paper type which is different from the standard paper type. In the present embodiment using different paper types for a book cover and a book body respectively, it is notified that the book cover is of a standard paper type and that the book body is of a non-standard paper type.

Figure 3:
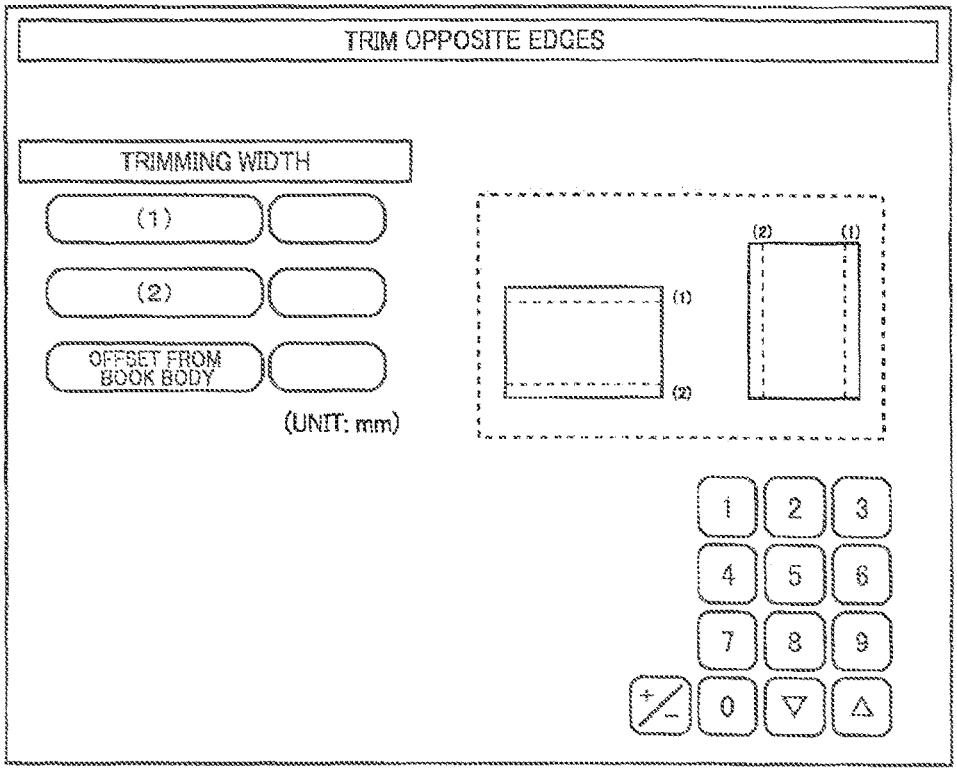
FIG. 3 is an explanatory view for showing an example of the method of setting trimming widths on a manipulation display of the image forming system as shown in FIG. 1.

On the other hand, as shown in FIG. 3, the main control unit 16 (as a base trimming width designation unit) designates the trimming width of paper edges, that is, in the case of the present embodiment, the trimming widths of the opposite edges corresponding to the top and bottom of a booklet on the basis of the information designated by a user through the manipulation display 15. This trimming width can be selected as a predetermined value within a range from zero to a maximum trimming width which can be cut off by the slit unit 32. Different trimming widths can be selected between one edge and the other edge.

The main control unit 16 (as an offset amount designation unit) designates an offset amount corresponding to the displacement of the sheet width of a book body from the sheet width of a book cover. In accordance with the present embodiment, the main control unit 16 designates the offset amount on the basis of the value designated by a user through the manipulation display 15. The designated offset amount is output to the finisher control unit 37.

When the main control unit 16 notifies that the sheet is supplied as the book cover, the finisher control unit 37 trims paper edges with the trimming width designated by the main control unit 16. On the other hand, when the main control unit 16 notifies that the sheet is supplied as the book body, the finisher control unit 37 trims paper edges on the basis of the offset amount designated by the main control unit 16. More specifically, the finisher control unit 37 trims the paper edges with the corrected trimming width calculated by adding the offset amount to the trimming width designated by the main control unit 16.

Figures 4, 7:
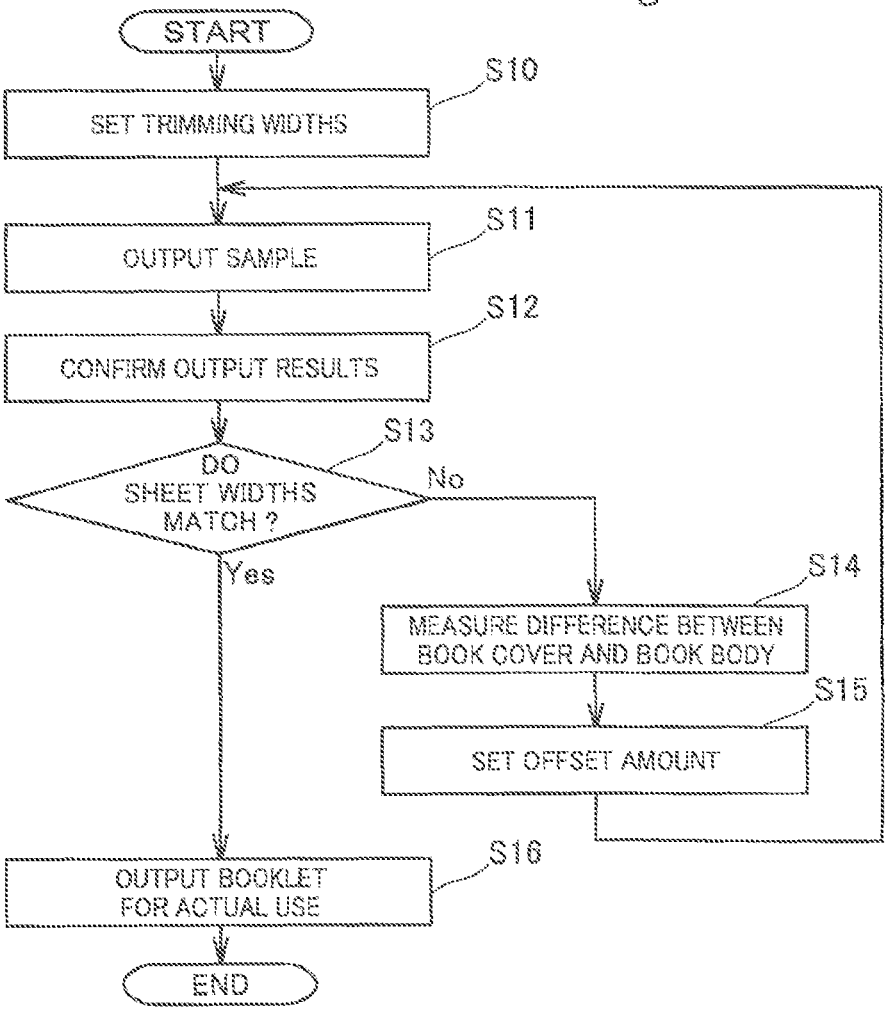
FIG. 4 is a flow chart for showing the procedure of setting an offset amount by a user himself for the image forming system as shown in FIG. 1.
FIG. 7 is an explanatory view for showing a table in which are defined offset amounts of non-standard paper types in relation to standard paper types respectively corresponding to a variety of combinations for the image forming system in accordance with the second embodiment.

Next is a description of a series of steps which are to be taken for assembling a booklet consisting of a book cover and a book body made from different paper types by using the image forming system of the present embodiment. FIG. 4 is a flow chart for showing the procedure of setting an offset amount by a user himself required for performing the job of preparing a booklet by the image forming system. In this case, the paper type of a book cover and the paper type of a book body are designated respectively through the manipulation display 15 by the user and acquired by the main control unit 16.

First, in step 10 (S10), the user inputs the trimming widths of the opposite ends of a sheet P through the manipulation display 15. The amount input by the user is acquired and designated as trimming widths by the main control unit 16.

In step 11 (S11), the user instructs outputting a sample through the manipulation display 15. The main control unit 16 receives the instruction of outputting a sample, and starts feeding a book cover (for example, a cardboard) from the paper feed unit 14. Then, the main control unit 16 supplies the fed sheet P to the finisher 30 from the image forming apparatus 10, and notifies the finisher control unit 37 of the designated trimming width and that this sheet P is used as a book cover. Since it is notified that the sheet P is supplied from the image forming apparatus 10 as a book cover, the finisher control unit 37 trims the paper edges in accordance with the trimming width which is designated for this sheet P (as a book cover) by the main control unit 16. After trimming the paper edge, the sheet P is discharged, for example, to a catch tray as it is without any processing.

Also, after trimming the paper edges of the book cover, the main control unit 16 feeds a book body (for example, thin sheets) from the paper feed unit 14. Then, while supplying the fed sheets P to the finisher 30 from the image forming apparatus 10, the main control unit 16 notifies the finisher control unit 37 of the designated trimming width and that this sheet P is used to form a book body. Since it is notified that the sheet P is supplied from the image forming apparatus 10 as a book body (of a different paper type than the book cover), the finisher control unit 37 trims the paper edges in accordance with the corrected trimming width calculated by adding the offset amount designated in step 15 as described below to the trimming width designated by the main control unit 16.

Incidentally, since the offset amount has not been designated yet just after starting up, the finisher control unit 37 uses an offset amount of zero.

In step 12 (S12), the user confirms the output results of the book cover and the book body.

In step 13 (S13), the user determines whether or not the book cover and the book body match in sheet width. If the determination is in the affirmative in step 13, i.e., if the book cover and the book body match in sheet width, the process proceeds to step 16 (S16) to be described below. Conversely, if the determination is in the negative in step 13, i.e., if the book cover and the book body are not aligned in sheet width, the process proceeds to step 14 (14).

In step 14, the user measures the difference between the book cover and the book body.

In step 15, the user sets an offset amount through the manipulation display 15. In this case, the user can set the offset amount to the measured difference. Then, the procedure is repeated from step 11.

In step 16, the user switches the operation mode through the manipulation display 15 to a mode of outputting a booklet for actual use (refer to FIG. 5 to be described below).

Figure 5:
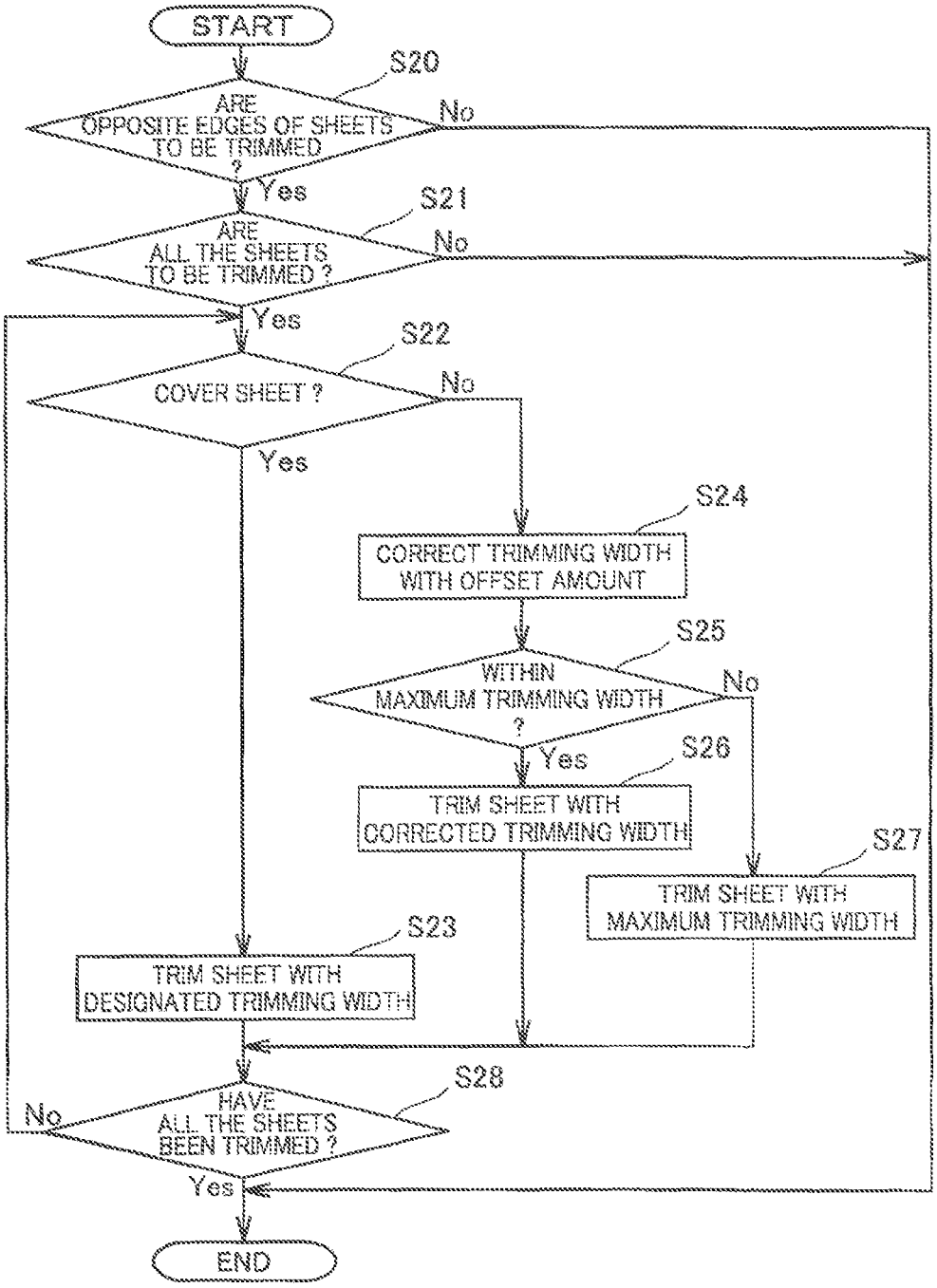
FIG. 5 is a flow chart showing the procedure of assembling a booklet in a series of control steps in the image forming system as shown in FIG. 1.

FIG. 5 is a flow chart showing the procedure of assembling a booklet in a series of control steps in the image forming system. The procedure shown in the flow chart is done when performing a job of outputting a booklet for actual use. In advance of performing this job, the user designates, through the manipulation display 15, the paper types used for forming a book cover and a book body respectively, whether to trim sheets at top and bottom edges thereof, the number of pages to be trimmed and the trimming width thereof, the offset amounts and so forth. The parameters designated by the procedure shown in FIG. 4 may be used in this case.

In step 20 (S20), the main control unit 16 determines whether or not the opposite edges of sheets are to be trimmed for preparing a booklet. If the determination is in the affirmative in step 20, i.e., if the opposite edges of sheets are to be trimmed, the process proceeds to step 21 (S21). Conversely, if the determination is in the negative in step 20, i.e., if the opposite edges of sheets are not to be trimmed, this routine returns control.

In step 21 (S21), the main control unit 16 determines whether or not all the pages of the booklet are to be trimmed for preparing a booklet. If the determination is in the affirmative in step 21, i.e., if all the pages of the booklet are to be trimmed, the process proceeds to step 22 (S22). Conversely, if the determination is in the negative in step 21, i.e., if all the pages of the booklet are not to be trimmed, this routine returns control.

In step 22, the main control unit 16 determines whether or not a book cover is supplied. If the determination is in the affirmative in step 22, i.e., if a book cover is supplied, the process proceeds to step 23 (S23). In this case, the main control unit 16 feeds a sheet P (for example, a cardboard) corresponding to the book cover from the paper feed unit 14. Then, the main control unit 16 supplies the fed sheet P to the finisher 30 from the image forming apparatus 10, and notifies the finisher control unit 37 of the trimming width and that this sheet P is used as a book cover. The trimming width notified to the finisher control unit 37 can be designated by the main control unit 16 on the basis of the amount designated by the user.

In step 23, since it is notified that the sheet P is supplied from the image forming apparatus 10 as a book cover, the finisher control unit 37 trims the paper edges in accordance with the trimming width which is designated for this sheet P (as a book cover) by the main control unit 16.

Conversely, if the determination is in the negative in step 22, i.e., if a book body is supplied, the process proceeds to step 24 (S24). In this case, the main control unit 16 feeds a sheet P (for example, a thin sheet) corresponding to the book body from the paper feed unit 14. Then, while supplying the fed sheet P to the finisher 30 from the image forming apparatus 10, the main control unit 16 notifies the finisher control unit 37 of the designated trimming width and that this sheet P is used to form a book body.

In step 24, since it is notified that the sheet P is supplied from the image forming apparatus 10 as a book body (of a different paper type than the book cover), the finisher control unit 37 corrects the trimming width on the basis of the offset amount designated by the main control unit 16. More specifically, the finisher control unit 37 sets the trimming width to a corrected trimming width which is calculated by adding the offset amount to the designated trimming width.

In step 25 (S25), the finisher control unit 37 determines whether or not the corrected trimming width falls within a maximum trimming width which can be cut off by the slit unit 32. This maximum trimming width is predetermined on the basis of the mechanical constraints of the slit unit 32 and so forth. If the determination is in the affirmative in step 25, i.e., the corrected trimming width falls within the maximum trimming width, the process proceeds to step 26 (S26). Conversely, if the determination is in the negative in step 25, i.e., the corrected trimming width exceeds the maximum trimming width, the process proceeds to step 27 (S27).

In step 26, the finisher control unit 37 trims the paper edges of a sheet P (book body) supplied from the image forming apparatus 10 in accordance with the corrected trimming width.

In step 27, the finisher control unit 37 replaces the corrected trimming width by the maximum trimming width, and trims the paper edges of a sheet P (book body) supplied from the image forming apparatus 10 in accordance with the trimming width after replacement.

In step 28 (S28), the main control unit 16 determines whether or not all the sheets P have completely been processed. If the determination is in the affirmative in step 28, this routine returns control. Conversely, if the determination is in the negative in step 28, the process returns to step 22.

As has been discussed above, in the image forming system of the present embodiment, when the main control unit 16 notifies that the sheet P is supplied from the image forming apparatus 10 as a book cover (standard paper type sheet P), the finisher control unit 37 trims the paper edges by the trimming width designated by the main control unit 16. On the other hand, when the main control unit 16 notifies that the sheet P is supplied from the image forming apparatus 10 as a book body (non-standard paper type sheet P), the finisher control unit 37 trims the paper edges by the corrected trimming width calculated by adding the offset amount to the trimming width designated by the main control unit 16.

By this configuration, the book body is trimmed by taking into consideration the offset amount corresponding to the displacement of the sheet width of the book body in relation to the sheet width of the book cover. With such an offset amount, the trimming width of the book body can be adjusted in agreement with the sheet width of the book cover even if the book cover and the book body are made from different paper types. The sheet widths of the book cover and the book body thereby match after trimming to assemble a high quality booklet as an output product.

Also, in accordance with the present embodiment, the trimming widths are corrected only with respect to relative differences among different paper types as the offset amount of a book body (non-standard paper type sheet P), rather than individually corrected for each paper type. Because of this, while to lighten the burden of determining the offset amount for each paper type, a booklet can be formed with uniform sheet widths.

In addition, the main control unit 16 of the present embodiment designates the offset amount on the basis of the amount designated by the user through the manipulation display 15 (as an offset amount designation unit).

The offset amount can therefore be designated corresponding to a preference desired by a user. It is therefore possible to provide a user-friendly image forming apparatus.

Also, when the corrected trimming width exceeds the maximum trimming width which can be cut off by the slit unit 32, the finisher control unit 37 of the present embodiment replaces the corrected trimming width by the maximum trimming width, and trims the paper edges in accordance with the trimming width after replacement.

By this configuration, even if the corrected trimming width exceeds the mechanical constraints, the slit unit 32 need not stop operation but can continue trimming within an operable range. It is therefore possible to inhibit the deterioration of productivity.

As has been discussed above, in accordance with the present embodiment, if the corrected trimming width exceeds the maximum trimming width, the trimming operation continues after the corrected trimming width is set to the maximum trimming width in accordance with the present embodiment. However, in such a case, it is possible to halt the operation of the image forming system and issue a warning through the manipulation display 15.

(Second Embodiment)

In what follows, a series of steps for assembling a booklet by an image forming system of the second embodiment will be explained. The procedure of the second embodiment differs from the procedure of the first embodiment as described above in that the offset amount is automatically set. The second embodiment will be explained below mainly with respect to the differences from the first embodiment without repeating redundant description.

Figure 6:
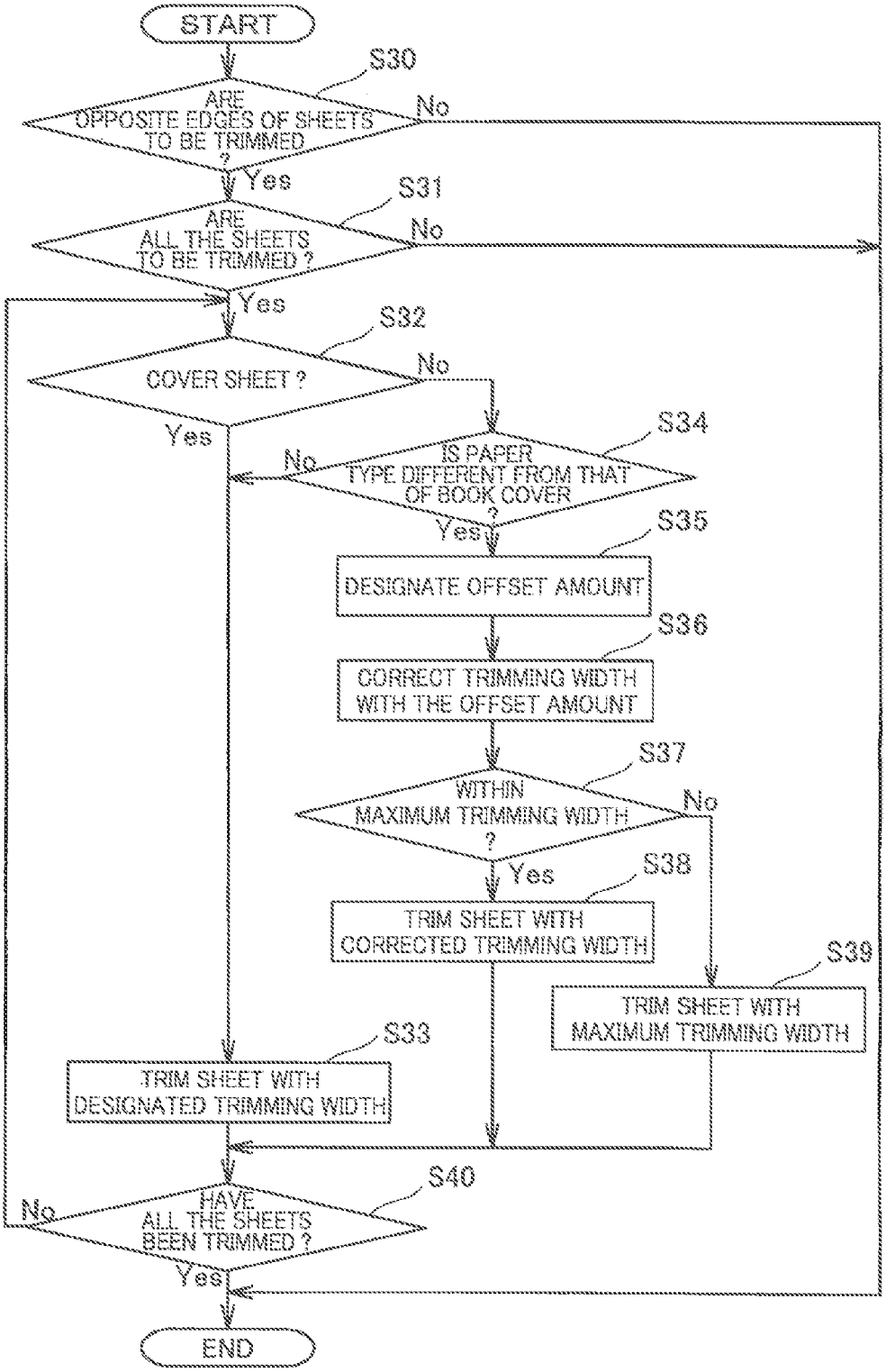
FIG. 6 is a flow chart showing the procedure of assembling a booklet in a series of control steps in the image forming system in accordance with a second embodiment of the present invention.

FIG. 6 is a flow chart showing the procedure of assembling a booklet in a series of control steps conducted in the image forming system. The procedure shown in the flow chart is done when performing a job of outputting a booklet for actual use. In advance of performing this job, the user designates, through the manipulation display 15, the paper types used for forming a book cover and a book body respectively, whether to trim sheets at top and bottom edges thereof, the number of pages to be trimmed and the trimming width thereof, and so forth.

In step 30 (S30), the main control unit 16 determines whether or not the opposite edges of sheets are to be trimmed for preparing a booklet. If the determination is in the affirmative in step 30, the process proceeds to step 31 (S31). Conversely, if the determination is in the negative in step 30, i.e., if the opposite edges of sheets are not to be trimmed, this routine returns control.

In step 31 (S31), the main control unit 16 determines whether or not all the pages of the booklet are to be trimmed for preparing a booklet. If the determination is in the affirmative in step 31, the process proceeds to step 32 (S32). Conversely, if the determination is in the negative in step 31, this routine returns control.

In step 32, the main control unit 16 determines whether or not a book cover is supplied. If the determination is in the affirmative in step 32, the process proceeds to step 33 (S33). In this case, the main control unit 16 feeds a sheet P (for example, a cardboard) corresponding to the book cover from the paper feed unit 14. Then, the main control unit 16 supplies the fed sheet P to the finisher 30 from the image forming apparatus 10, and notifies the finisher control unit 37 of the trimming width and that this sheet P is used as a book cover.

In step 33, since it is notified that the sheet P is supplied from the image forming apparatus 10C as a book cover, the finisher control unit 37 trims the paper edges in accordance with the trimming width which is designated for this sheet P (as a book cover) by the main control unit 16.

Conversely, if the determination is in the negative in step 32, i.e., if a book body is supplied, the process proceeds to step 34 (S34).

In step 34, the main control unit 16 determines whether or not the book body is to be made from a different paper type than the book cover. If the determination is in the negative in step 34, i.e., if the book body and the book cover are to be made from the same paper type, the process proceeds to step 33 as described above. At this time, the main control unit 16 feeds a sheet P (for example, a cardboard) corresponding to the book body from the paper feed unit 14. Then, the main control unit 16 supplies the fed sheet P to the finisher 30 from the image forming apparatus 10, and notifies the finisher control unit 37 of the trimming width and that this sheet P is used as a book body. In step 33, since it is notified that the sheet P is supplied from the image forming apparatus 10 as a book body (of the same paper type as the book cover), the finisher control unit 37 trims the paper edges in accordance with the trimming width which is designated for this sheet P (as a book body) by the main control unit 16.

Conversely, if the determination is in the affirmative in step 34, i.e., if the book body and the book cover are of different paper types, the process proceeds to step 35 (S35). In step 35, the main control unit 16 designates an offset amount. The main control unit 16 includes a storing device (for example, a ROM) for storing a table as shown in FIG. 7 in which are defined offset amounts of non-standard paper types in relation to standard paper types respectively corresponding to a variety of combinations. In this step 35, the main control unit 16 refers to the paper types of the book cover and book body, and designates an offset amount on the basis of the table stored in the storing device.

Also, the main control unit 16 feeds a sheet P (for example, a thin sheet) corresponding to the book body from the paper feed unit 14. Then, while supplying the fed sheet P to the finisher 30 from the image forming apparatus 10, the main control unit 16 notifies the finisher control unit 37 of the trimming width, the offset amount and that this sheet P is used to form a book body.

In step 36, since it is notified that the sheet P is supplied from the image forming apparatus 10 as a book body (of a different paper type than the book cover), the finisher control unit 37 corrects the trimming width on the basis of the offset amount designated by the main control unit 16. More specifically, the finisher control unit 37 sets the trimming width to a corrected trimming width which is calculated by adding the offset amount which is designated in step 35 to the designated trimming width.

In step 37 (S37), the finisher control unit 37 determines whether or not the corrected trimming width falls within a maximum trimming width which can be cut off by the slit unit 32. If the determination is in the affirmative in step 37, i.e., the corrected trimming width falls within the maximum trimming width, the process proceeds to step 38 (S38). Conversely, if the determination is in the negative in step 37, i.e., the corrected trimming width exceeds the maximum trimming width, the process proceeds to step 39 (S39).

In step 38, the finisher control unit 37 trims the paper edges of the sheet P (book body) supplied from the image forming apparatus 10 in accordance with the corrected trimming width.

In step 39, the finisher control unit 37 replaces the corrected trimming width by the maximum trimming width, and trims the paper edges of the sheet P (book body) supplied from the image forming apparatus 10 in accordance with the trimming width after replacement.

As has been discussed above, the main control unit 16 of the present embodiment designates an offset amount on the basis of the table stored in the storing device.

By this configuration, the offset amount can be automatically adjusted in accordance with each of different paper types. The user need therefore not operate the system so that a user-friendly image forming apparatus can be realized.

In accordance with the present embodiment as described above, the offset amount is automatically determined by taking only the paper types into consideration. However, even if considering only the same paper type, the warp amount tends to increase as the size increase. The main control unit 16 as an offset amount designation unit can therefore designate the offset amount by further taking the size of a sheet P into consideration. For example, the offset amount determined in accordance with a paper type may be increased by a correction value which is set to a larger value as the size of a sheet P increases. This scheme can be applied also to the calculation of the offset amount in accordance with the first embodiment in the same manner.

Meanwhile, the booklet provided as an output product by each of the first and second embodiments as described above includes two paper types for a book cover and a book body. However, the booklet as an output product can include three or more paper types, e.g., one for a book cover and two or more for a book body.

Also, in the case where there are three or more paper types, any paper type can be used as a standard paper type. However, it is preferred to use the paper type of a book cover as a standard paper type and the other paper types of a book body as a non-standard paper type. In such a case, the paper types of the book body positioned inside the book cover are given offset amounts respectively which are set up relative to the book cover P. While the trimming error between the book cover and the book body can be corrected by the offset amount, there may be some relative trimming error between different paper types of the book body. Appearance after making up the booklet determines the quality of the output product. Even if there occurs some relative trimming error among sheets of the book body, it is avoided that the edge of the book body protrudes from the book cover which is used as a reference of trimming the book body. It is therefore possible to inhibit the appearance of an output product from being degraded.

Also, while the finisher 30 of the first or second embodiment of the present invention is used to assemble a saddle-stitched booklet as an output product, the present, invention is not limited thereto. The finisher 30 may be any type of a finisher capable of processing a plurality of sheets P successively supplied from the image forming apparatus 10 to bind the sheets P together as one output product. The output product may for example be a book assembled by case binding, a booklet assembled by binding sheets together at edges with staples, a simple stack of a plurality of sheets or the like.

For example, the image forming system in accordance with the above embodiments includes an image forming apparatus and a finisher. However, the present invention can be considered to relate also to the image forming apparatus itself comprises: (1) an image forming unit configured to form an image on a sheet; (2) a finisher unit provided with a slit unit for trimming edges of sheets which are successively supplied from the image forming unit, and configured to assemble an output product by joining the trimmed sheets; and (3) a control unit configured to control each of the image forming unit and the finisher unit, wherein the finisher unit can assemble the output product with sheets of a plurality of paper types including a standard paper type and a non-standard paper type which is different from the standard paper type. In this case, the control unit (3) comprises: (3-1) a paper type notification unit configured to notify which of the standard paper type and non-standard paper type is supplied to the finisher unit from the image forming unit; (3-2) a finisher unit configured to control the operation of the slit unit in accordance with the paper type of sheets supplied to the finisher unit; and (3-3) an offset amount designation unit configured to designate an offset amount corresponding to the displacement of the sheet width of the non-standard paper type in relation to the sheet width of the standard paper type, wherein when the paper type notification unit notifies that the non-standard paper type is supplied, the finisher control unit trims the edge of a sheet on the basis of the offset amount designated by the offset amount designation unit.

Also, the present invention can be considered to relate also to the finisher itself including the above mentioned "paper type notification unit", "finisher control unit" and "offset amount designation unit". In this case, the image forming apparatus is not necessarily provided as a sheet source, but the finisher may be of an offline-typo.

In accordance with the image forming system, the image forming apparatus or the finisher as described above a non-standard paper type sheet is trimmed by taking into consideration the offset amount corresponding to the displacement of the sheet width of the non-standard paper type sheet in relation to the sheet width of a standard paper type sheet. With such an offset amount, the trimming width of the non-standard paper type sheet can be adjusted in agreement with the sheet width of the standard paper type sheet. The standard paper type sheet and the non-standard paper type sheet therefore can match in sheet width after trimming to provide a high quality output product.

Furthermore, the present invention can be considered to relate also to the control method for assembling output products in accordance with the above embodiments. This control method can be applied to any of the image forming system, the image forming apparatus and the finisher in accordance with the present invention.

Still further, while the operation of the image forming system is controlled by the control units which are provided for the respective apparatuses, a dedicated control unit can be provided for performing the above-mentioned process of assembling output products as a separate unit from the control units for controlling the image forming apparatus and the finisher. For example, the image forming apparatus can be connected through a network to a personal computer in which a server application and a printer driver are installed to monitor the behavior of the image forming apparatus or the like and conduct the control method for assembling output products.

What is claimed is:

1. An image forming system comprising:

an image forming apparatus configured to form an image on a sheet;

a finisher provided with a slit unit for trimming edges of sheets which are successively supplied from the image forming apparatus, and configured to assemble an output product by joining the trimmed sheets; and a control unit configured to control each of the image forming apparatus and the finisher, wherein the finisher can assemble the output product with sheets of a plurality of paper types including a standard paper type and a non-standard paper type which is different from the standard paper type, the control unit comprising:

a paper type notification unit configured to notify which of the standard paper type and non-standard paper type is supplied to the finisher from the image forming apparatus;

a finisher control unit configured to control an operation of the slit unit in accordance with the paper type of sheets supplied to the finisher; and an offset amount designation unit configured to designate an offset amount corresponding to a displacement of a sheet width of the non-standard paper type in relation to a sheet width of the standard paper type, wherein when the paper type notification unit notifies that the non-standard paper type is supplied, the finisher control unit trims the edge of a sheet on the basis of the offset amount designated by the offset amount designation unit.

2. The image forming system of claim 1 wherein the control unit further comprising a base trimming width designation unit which designates a trimming width of the edge of a sheet for assembling the output product, and wherein when the paper type notification unit notifies that the standard paper type is supplied, the finisher control unit trims the edge of a sheet in accordance with the trimming width designated by the base trimming width designation unit, and when the paper type notification unit notifies that the non-standard paper type is supplied, the edge of a sheet is trimmed in accordance with a corrected trimming width calculated by adding the offset amount designated by the offset amount designation unit to the trimming width designated by the base trimming width designation unit.

3. The image forming system of claim 1 wherein the output product consists of a book cover and a book body which is made from sheets of one or more paper type different from that of the book cover, and wherein the paper type notification unit notifies, when the supplied sheet is used as a book cover, that the standard paper type is supplied, and notifies, when the supplied sheet is used as a book body, that the non-standard paper type is supplied.

4. The image forming system of claim 1 further comprising:

an input unit through which a user can perform input operation, wherein the offset amount designation unit designates the offset amount on the basis of the amount designated by the user through the input unit.

5. The image forming system of claim 1 further comprising:

a storing device configured to store a table in which is defined an offset amount of the non-standard paper type in relation to the standard paper type corresponding to a variety of combinations of the non-standard paper type and the standard paper type, wherein the offset amount designation unit designates the offset amount with reference to the table stored in the storing device.

6. The image forming system of claim 1 wherein the offset amount designation unit designates the offset amount on the basis of the size of the supplied sheet.

7. The image forming system of claim 2 wherein when the corrected trimming width exceeds the maximum trimming width which can be cut off by the slit unit, the finisher control unit replaces the corrected trimming width by the maximum trimming width, and trims the edge of a sheet in accordance with the trimming width after replacement.

8. The image forming system of claim 2 further comprising:

a notification unit configured to notify a user of information, wherein when the corrected trimming width exceeds the maximum trimming width which can be cut off by the slit unit, the finisher notifies that the corrected trimming width exceeds the maximum trimming width through the notification unit.

9. The image forming system of claim 2 wherein after trimming the paper edges of sheets by the slit unit, the finisher performs a predetermined post-printing process on the trimmed sheets to provide the output product.

10. An image forming apparatus comprising:

an image forming unit configured to form an image on a sheet;

a finisher unit provided with a slit unit for trimming edges of sheets which are successively supplied from the image forming unit, and configured to assemble an output product by joining the trimmed sheets; and a control unit configured to control each of the image forming unit and the finisher unit, wherein the finisher unit can assemble the output product with sheets of a plurality of paper types including a standard paper type and a non-standard paper type which is different from the standard paper type, the control unit comprising:

a paper type notification unit configured to notify which of the standard paper type and non-standard paper type is supplied to the finisher unit from the image forming unit;

a finisher control unit configured to control an operation of the slit unit in accordance with the paper type of sheets supplied to the finisher unit; and an offset amount designation unit configured to designate an offset amount corresponding to a displacement of a sheet width of the non-standard paper type in relation to a sheet width of the standard paper type, wherein when the paper type notification unit notifies that the non-standard paper type is supplied, the finisher control unit trims the edge of a sheet on the basis of the offset amount designated by the offset amount designation unit.

11. An finisher provided with a slit unit for trimming edges of sheets which are successively supplied from the sheet, source, and configured to assemble an output product by joining sheets of a plurality of paper types including a standard paper type and a non-standard paper type which is different from the standard paper type, said finisher comprising:

a paper type notification unit configured to notify which of the standard paper type and non-standard paper type is supplied from the sheet source?

a finisher control unit configured to control an operation of the slit unit in accordance with the paper type of sheets supplied from the sheet source; and an offset amount designation unit configured to designate an offset amount corresponding to a displacement of a sheet width of the non-standard paper type in relation to a sheet width of the standard paper type, wherein when the paper type notification unit notifies that the non-standard paper type is supplied, the finisher control unit trims the edge of a sheet on the basis of the offset amount designated by the offset amount designation unit.

12. A method of controlling an image forming system which comprises:

an image forming apparatus configured to form an image on a sheet; and a finisher provided with a slit unit for trimming edges of sheets which are successively supplied from the image forming apparatus, and configured to assemble an output product by joining sheets of a plurality of paper types including a standard paper type and a non-standard paper type which is different from the standard paper type, said method comprising:

a first step of notifying which of the standard paper type and non-standard paper type is supplied to the finisher from the image forming apparatus;

a second step of designating an offset amount corresponding to a displacement of a sheet width of the non-standard paper type in relation to a sheet width of the standard paper type; and a third step of, when the paper type notification unit notifies that the non-standard paper type is supplied, trimming the edge of a sheet on the basis of the designated offset amount.

13. The image forming system controlling method of claim 12 further comprising:

a fourth step of designating a trimming width of the edge of a sheet for assembling the output product, wherein in the third step, when it is notified that the standard paper type is supplied, the edge of a sheet is trimmed in accordance with the trimming width designated in the fourth step, and when it is notified that the non-standard paper type is supplied, the edge of a sheet is trimmed in accordance with a corrected trimming width calculated by adding the offset amount designated in the second step to the trimming width designated in the fourth step.

14. The image forming system controlling method of claim 12 wherein the output product consists of a book cover and a book body which is made from sheets of one or more paper type different from that of the book cover, and wherein in the step 1, when the supplied sheet is used as a book cover, it is notified that the standard paper type is supplied, and when the supplied sheet is used as a book body, it is notified that the non-standard paper type is supplied.

15. The image forming system controlling method of claim 12 wherein in the step 2, the offset amount is designated on the basis of the amount designated by a user through an input unit.

16. The image forming system controlling method of claim 12 wherein in the step 2, the offset amount is designated with reference to a table stored in the storing device for defining an offset amount of the non-standard paper type in relation to the standard paper type corresponding to a variety of combinations of the non-standard paper type and the standard paper type.

17. The image forming system controlling method of claim 12 wherein in the step 2, the offset amount is designated on the basis of the size of the supplied sheet.

18. The image forming system controlling method of claim 13 wherein in the step 3, when the corrected trimming width exceeds the maximum trimming width which can be cut off by the slit unit, the corrected trimming width is replaced with the maximum trimming width, and used to trim the edge of a sheet in accordance with the trimming width after replacement.

19. The image forming system controlling method of claim 13 wherein in the step 3, when the corrected trimming width exceeds the maximum trimming width which can be cut off by the slit unit, it is notified to a user that the corrected trimming width exceeds the maximum trimming width through a notification unit.

20. The image forming system controlling method of claim 13 wherein after trimming the paper edges of sheets by the slit unit, a predetermined post-printing process is further performed on the trimmed sheets to provide the output product.

* * * * *